US007879121B2

(12) United States Patent
Oh

(10) Patent No.: US 7,879,121 B2
(45) Date of Patent: Feb. 1, 2011

(54) CYCLONE DUST-COLLECTING APPARATUS FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 342 days.

(21) Appl. No.: 12/214,308

(22) Filed: Jun. 18, 2008

(65) Prior Publication Data

US 2009/0205299 A1 Aug. 20, 2009

(30) Foreign Application Priority Data

Feb. 15, 2008 (KR) ..... 10-2008-0014212

(51) Int. Cl.
*B01D 45/12* (2006.01)

(52) U.S. Cl. ..... 55/347; 55/343; 55/345; 55/346; 55/337; 55/458; 55/428; 55/429; 55/459.1; 55/459.2; 15/352; 15/353

(58) Field of Classification Search ..... 55/343, 55/345, 346, 347, 349, 337, 458, 428, 429, 55/459.1, 459.2; 15/352, 353
See application file for complete search history.

(56) References Cited

U.S. PATENT DOCUMENTS

| | | | | |
|---|---|---|---|---|
| 3,349,548 | A * | 10/1967 | Boyen | 55/457 |
| 5,236,479 | A * | 8/1993 | Billingsley | 55/337 |
| 7,534,279 | B2 * | 5/2009 | Oh et al. | 55/343 |
| 2003/0226232 | A1 * | 12/2003 | Hayashi et al. | 15/353 |
| 2005/0252180 | A1 * | 11/2005 | Oh et al. | 55/345 |
| 2006/0090428 | A1 * | 5/2006 | Park et al. | 55/337 |
| 2006/0123751 | A1 * | 6/2006 | Hayashi et al. | 55/428 |
| 2006/0137309 | A1 * | 6/2006 | Jeong et al. | 55/337 |
| 2006/0156699 | A1 * | 7/2006 | Kim | 55/345 |
| 2006/0230717 | A1 * | 10/2006 | Oh et al. | 55/343 |
| 2007/0011997 | A1 * | 1/2007 | Han et al. | 55/337 |
| 2007/0079581 | A1 * | 4/2007 | Kim et al. | 55/345 |

(Continued)

FOREIGN PATENT DOCUMENTS

| | | |
|---|---|---|
| EP | 0018197 | 10/1980 |

(Continued)

OTHER PUBLICATIONS

British Combined Search and Examination Report dated Dec. 17, 2008 corresponding to Application No. GB0815516.0.

*Primary Examiner*—Jason M Greene
*Assistant Examiner*—Dung Bui
(74) *Attorney, Agent, or Firm*—Ohlandt, Greeley, Ruggiero & Perle, LLP

(57) ABSTRACT

A cyclone dust-collecting apparatus is provided. The dust-collecting apparatus is detachably mounted in a main cleaner body of a vacuum cleaner and disposed on a suction flow path extending from a suction port body to a suction source. The dust-collecting apparatus includes a body having an opened lower portion; at least one cyclone unit disposed to one side in the body to separate dust from air flowing into the body and discharge air from which the dust has been separated; and a bottom cover to open or close the lower portion of the body. The body has an inflow pipe penetrating the body from a rear portion of the body and connected to the cyclone unit and the inflow pipe has an inclined top surface.

16 Claims, 5 Drawing Sheets

U.S. PATENT DOCUMENTS

| | | | | |
|---|---|---|---|---|
| 2007/0214754 | A1* | 9/2007 | Kim | 55/345 |
| 2007/0271725 | A1* | 11/2007 | Han et al. | 15/349 |
| 2007/0289263 | A1* | 12/2007 | Oh et al. | 55/318 |
| 2007/0289266 | A1* | 12/2007 | Oh | 55/337 |
| 2007/0289269 | A1* | 12/2007 | Oh et al. | 55/459.1 |
| 2008/0172992 | A1* | 7/2008 | Conrad | 55/323 |
| 2009/0205298 | A1* | 8/2009 | Hyun et al. | 55/343 |
| 2010/0000185 | A1* | 1/2010 | Hyun et al. | 55/343 |

FOREIGN PATENT DOCUMENTS

| | | |
|---|---|---|
| GB | 2365324 | 10/2000 |
| GB | 2418162 | 3/2006 |
| JP | 2004-135700 | 5/2004 |
| KR | 100706622 | 4/2007 |
| WO | WO03/041551 | 5/2003 |
| WO | WO 2007126181 A1 * | 11/2007 |

* cited by examiner

CYCLONE DUST-COLLECTING APPARATUS FOR VACUUM CLEANER

CROSS-REFERENCE TO RELATED APPLICATIONS

This application claims the benefit under 35 U.S.C. §119 (a) Korean Patent Application No. 10-2008-14212, filed on Feb. 15, 2008, in the Korean Intellectual Property Office, and the entire disclosure of which is incorporated herein by reference.

BACKGROUND OF THE INVENTION

1. Field of the Invention

The present disclosure relates to a cyclone dust-collecting apparatus for a vacuum cleaner, and more particularly, to a cyclone dust-collecting apparatus mounted in a vacuum cleaner to separate dust from air drawn inside the vacuum cleaner through a suction port body using a suction force and to collect the separated dust.

2. Description of the Related Art

Cyclone dust-collecting apparatuses for vacuum cleaners generally separate dust from air drawn inside the vacuum cleaner through a suction port body, collect the separated dust, and discharge air from which dust has been separated toward a suction motor.

Such cyclone dust-collecting apparatuses are disposed on suction flow paths that connect suction port bodies and suction motors, and include cyclone units and dust-collecting units. Cyclone units cause dust and air to whirl so that dust is separated from the air using the centrifugal force generated thereby. Air from which dust has been separated is discharged from the cyclone dust-collecting apparatus through discharge pipes, or is guided to following cyclone units when there are multi-cyclone units. Additionally, dust-collecting units collect dust discharged from cyclone units, and may be formed integrally with or separately from cyclone units.

Unfortunately, current cyclone dust-collecting apparatuses allow dust to settle on components inside the apparatus. Further, current cyclone dust-collecting apparatuses have proven difficult to empty and, thus, allow dust to remain inside the body when the cyclone dust-collecting apparatus is emptied

SUMMARY OF THE INVENTION

The present disclosure has been developed in order to solve the above described and other problems in the related art. Accordingly, an aspect of the present disclosure is to provide a cyclone dust-collecting apparatus capable of guiding dust so that dust does not settle on top surfaces of components disposed inside a body of the cyclone dust-collecting apparatus, and preventing dust from remaining inside the body when the cyclone dust-collecting apparatus is emptied.

Another aspect of the present disclosure is to provide a cyclone dust-collecting apparatus capable of having greater dust-collecting capacity, while maintaining a compact size.

The above aspects are achieved by providing a cyclone dust-collecting apparatus detachably mounted in a main cleaner body of a vacuum cleaner and disposed on a suction flow path extending from a suction port body to a suction source, the cyclone dust-collecting apparatus including a body having an opened lower portion; at least one cyclone unit disposed to one side in the body to separate dust from air flowing into the body and discharge air from which the dust has been separated; and a bottom cover to open or close the lower portion of the body, wherein the body has an inflow pipe penetrating the body from a rear portion of the body and connected to the cyclone unit, and the inflow pipe has an inclined top surface.

The inflow pipe may be connected at a tangent to one side of the cyclone unit. The inflow pipe may be disposed along an inside wall of the body, and the top surface of the inflow pipe may be inclined downwards so that the distance between the top surface of the inflow pipe and the inside wall of the body may become longer. Accordingly, dust that has settled on the top surface of the inflow pipe falls and is collected in the lower portion of the body rather than being deposited on the top surface, so it is possible to prevent dust from remaining inside the body due to components of the body.

The cyclone unit may include a discharge pipe to discharge air from which dust has been separated, and a bottom end of the discharge pipe may be connected to an extension pipe fluidly communicating with a portion of the bottom cover.

The cyclone unit may protrude outwards from the body and have a portion overlapping with the body, and thus dust-collecting space may increase.

The body may have an opened upper portion. The cyclone dust-collecting apparatus may further include a top cover to open and close the upper portion of the body. In this situation, a handle may be disposed above the top cover, and a stabilizing tube may extend from an inner surface of the top cover and face the discharge pipe of the cyclone unit.

The above aspects are achieved by providing a cyclone dust-collecting apparatus detachably mounted in a main cleaner body of a vacuum cleaner and disposed on a suction flow path extending from a suction port body to a suction source, the cyclone dust-collecting apparatus including a body including a first chamber and a second chamber that are divided by a partition; a first cyclone unit and a second cyclone unit that are disposed to one side in the first and second chambers, respectively, to separate dust from air flowing into the body through the suction flow path and discharge air from which the dust has been separated; and a bottom cover to open and close a lower portion of the body. The body may include a first inflow pipe and a second inflow pipe penetrating the body from a rear portion of the body and connected to the first and second cyclone units, respectively, and the first and second inflow pipes may have inclined top surfaces. The first and second inflow pipes may be connected at a tangent to respective sides of the first and second cyclone units, respectively, so that dust and air are made to whirl inside the first and second cyclone units.

The first and second inflow pipes may be disposed along an inside wall of the body, and the top surfaces of the first and second inflow pipes may be inclined downwards so that the distance between the top surfaces of the first and second inflow pipes and the inside wall of the body may become longer. Accordingly, dust may fall and may be collected in lower portions of the first and second chambers rather than being deposited on the top surfaces of the first and second inflow pipes.

The first and second inflow pipes may be disposed along the partition of the body, and the top surfaces of the first and second inflow pipes may be inclined downwards so that the distance between the top surfaces of the first and second inflow pipes and the partition of the body may become longer.

The first and second cyclone units may include a first discharge pipe and a second discharge pipe to discharge air from which dust has been separated, respectively, and bottom ends of the first and second discharge pipes are connected to a single extension pipe fluidly communicating with a portion of the bottom cover.

The extension pipe may be disposed along the inside wall of the body. In order to prevent dust from being deposited on a top surface of the extension pipe, the top surface of the extension pipe may be inclined downwards so that the distance between the top surface of the extension pipe and the inside wall of the body may become longer.

The first and second cyclone units may include a first discharge pipe and a second discharge pipe to discharge air from which dust has been separated, respectively, and bottom ends of the first and second discharge pipes are connected to a pair of extension pipes fluidly communicating with a portion of the bottom cover, respectively.

The first and second cyclone units may protrude outwards from the body and have portions overlapping with the body, respectively, so dust-collecting space in the first and second chambers may increase.

The cyclone dust-collecting apparatus may further include a top cover to open and close an upper portion of the body. A handle may be disposed above the top cover, and a first stabilizing tube and a second stabilizing tube may extend from an inner surface of the top cover and face the first and second discharge pipes, respectively. Accordingly, dust and air are made to stably whirl inside the first and second cyclone units.

According to the present disclosure, dust not settle on top surfaces of the components, such as the inflow pipe or extension pipe, disposed inside the body of the cyclone dust-collecting apparatus, and falls into the lower portion of the body, so that it is possible to prevent dust from remaining inside the body and to empty the body once.

Additionally, according to the present disclosure, the cyclone unit partially protrudes from the body, so it is possible to have greater dust-collecting capacity while maintaining a compact size.

BRIEF DESCRIPTION OF THE DRAWING FIGURES

The above and other advantages of the present disclosure will be more apparent by describing exemplary embodiments of the present disclosure with reference to the accompanying drawing figures, in which.

Throughout the drawings, like reference numerals will be understood to refer to like parts, components and structures.

DETAILED DESCRIPTION OF AN EXEMPLARY EMBODIMENT

Hereinafter, a cyclone dust-collecting apparatus for a vacuum cleaner according to an exemplary embodiment of the present disclosure will be described in greater detail with reference to FIGS. 1 to 8.

Figure 1:
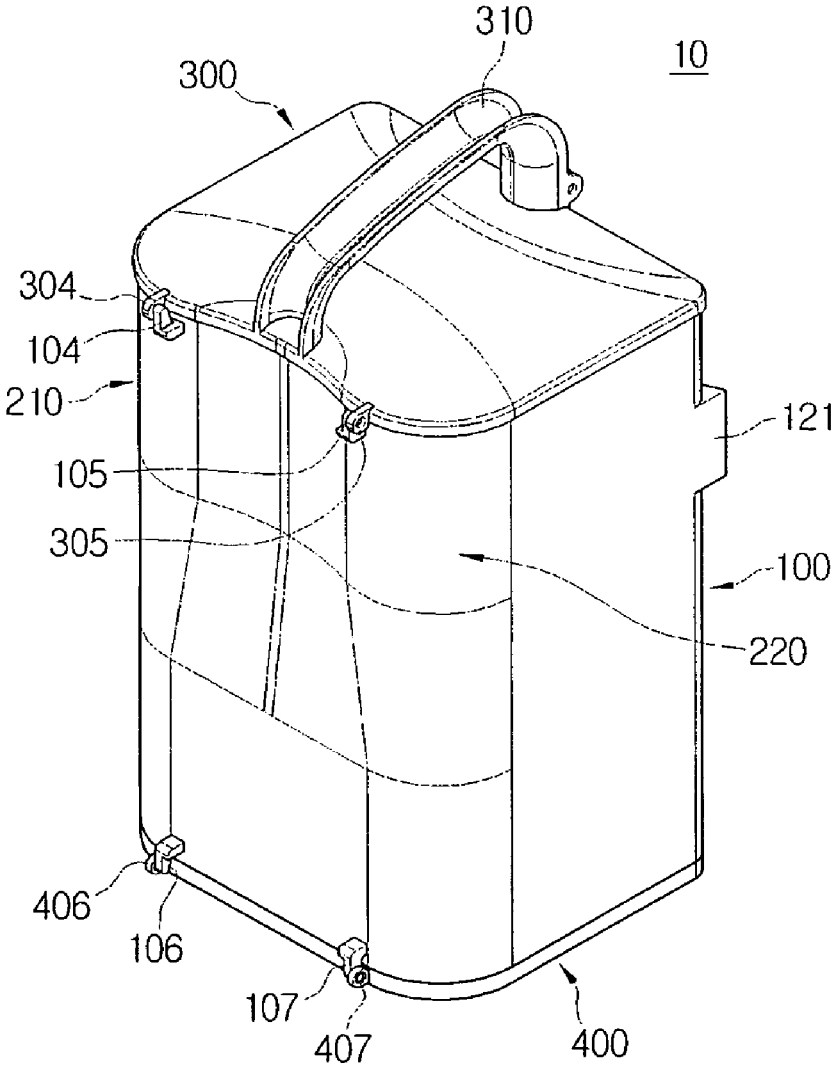
FIG. 1 is a front, top perspective view of a cyclone dust-collecting apparatus according to an exemplary embodiment of the present disclosure.

A cyclone dust-collecting apparatus 10 is detachably mounted in a main cleaner body (not illustrated) of a vacuum cleaner and is disposed on a suction flow path extending from a suction port body (not illustrated) to a suction source (not illustrated). Referring to FIG. 1, the cyclone dust-collecting apparatus 10 includes a body 100, a first cyclone unit 210, a second cyclone unit 220, a top cover 300, and a bottom cover 400.

Figure 2:
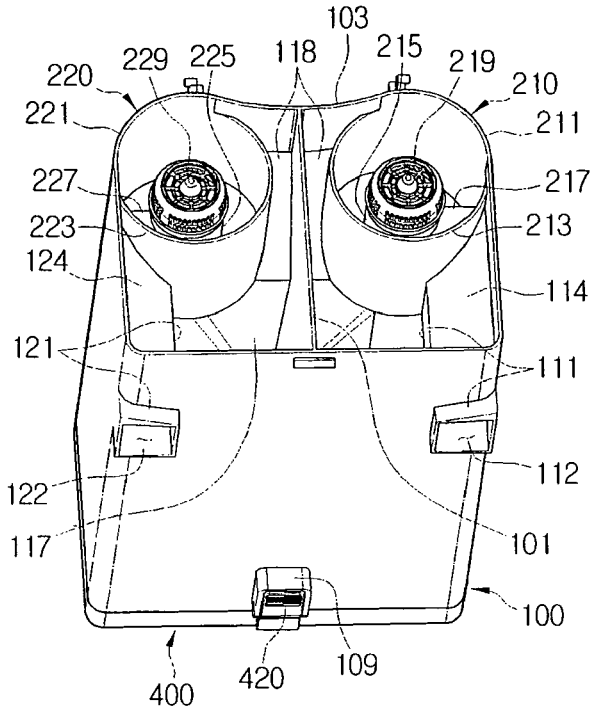
FIG. 2 is a rear, top perspective view of a cyclone dust-collecting apparatus with a top cover removed according to an exemplary embodiment of the present disclosure.
Figure 3:
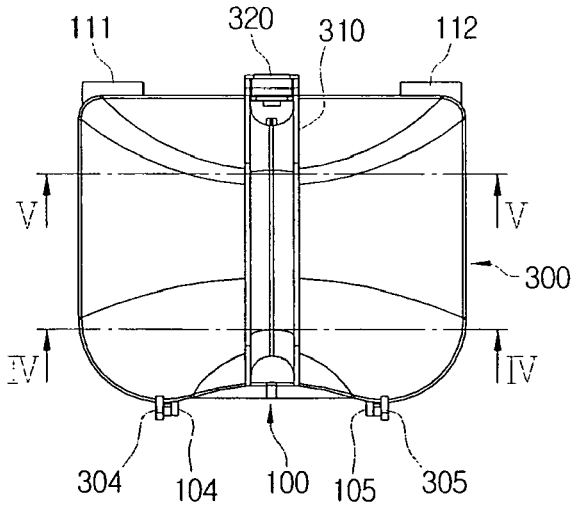
FIG. 3 is a top view of the cyclone dust-collecting apparatus of FIG. 1.

Referring to FIG. 2, the body 100 is formed in a substantially rectangular shape with opened top and bottom portions, and is divided into a first chamber 110 and a second chamber 120 by a partition 101 formed vertically on the center of the body 100. The first chamber 110 and second chamber 120 are substantially symmetrical to each other. The body 100 includes a first inflow pipe 111, a second inflow pipe 121, and an extension pipe 117.

Figure 4:
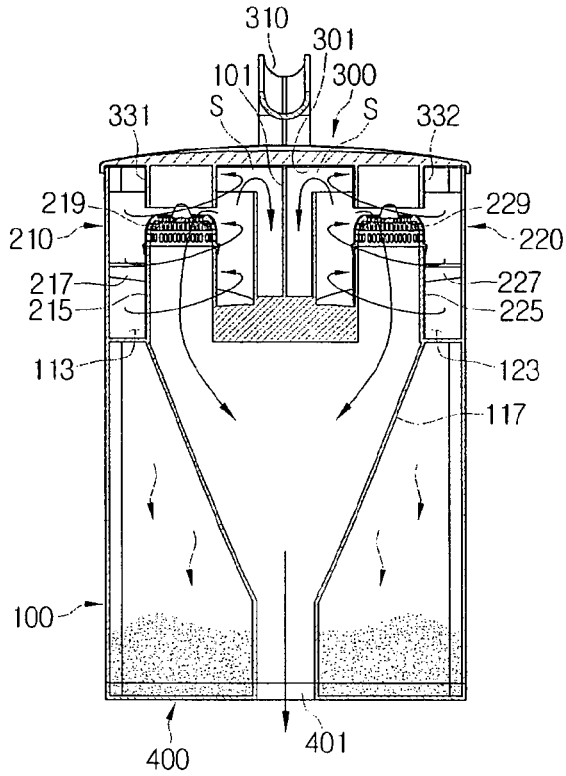
FIG. 4 is a sectional view of the cyclone dust-collecting of FIG. 1, taken along line IV-IV in FIG. 3.
Figure 5:
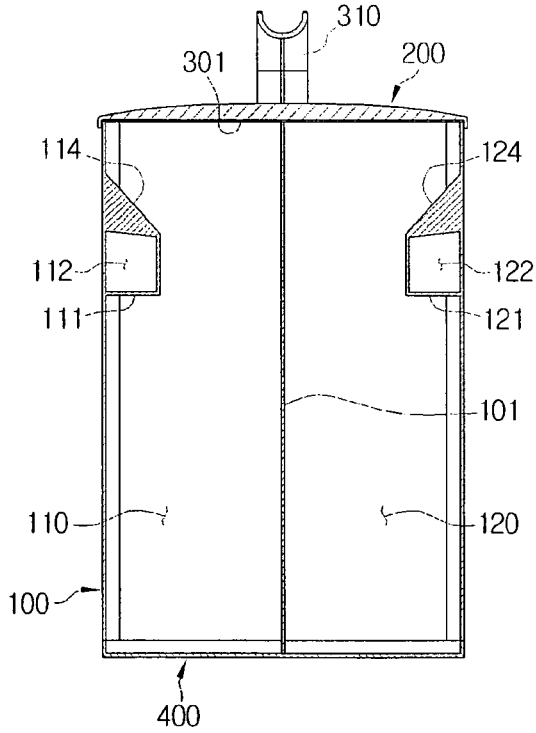
FIG. 5 is a sectional view of the cyclone dust-collecting of FIG. 1, taken along line V-V in FIG. 3.
Figure 6:
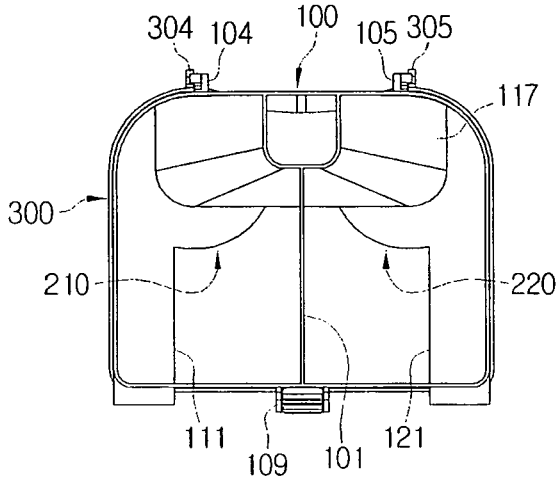
FIG. 6 is a bottom view of a cyclone dust-collecting apparatus with a bottom cover removed according to an exemplary embodiment of the present disclosure.

The first and second inflow pipes 111 and 121 extend horizontally from the rear of the body 100 along the inside walls of the first and second chambers 110 and 120, respectively. In this situation, inlets 112 and 122 to the first and second chambers 110 and 120 are disposed on the left and right sides of the body 100, respectively. Additionally, outlets 113 and 123 from the first and second inflow pipes 111 and 121 are connected tangentially to respective sides of the first cyclone unit 210 and second cyclone unit 220, respectively, as shown in FIG. 4. Referring to FIG. 5, the greater the distance between top surfaces 114 and 124 of the first and second inflow pipes 111 and 121 and the inside wall of the body 100, the greater the downward slant of the first and second inflow pipes 111 and 121. This is because dust discharged through a discharge space S (FIG. 4) of the first and second cyclone units 210 and 220 falls into the lower portions of the first and second chambers 110 and 120 respectively rather than settling on the top surfaces 114 and 124 of the first and second inflow pipes 111 and 121.

The first and second inflow pipes 111 and 121 are disposed on the inside wall of the body 100 in this exemplary embodiment of the present disclosure, but there is no limitation to such a configuration. Accordingly, the first and second inflow pipes 111 and 121 may be disposed on the partition 101, and the inlets 112 and 122 may thus be disposed substantially in the center of the rear of the body 100 and the outlets 113 and 123 may be connected at a tangent to respective sides of the first and second cyclone units 210 and 220. Additionally, the greater the distance between the top surfaces 114 and 124 of the first and second inflow pipes 111 and 121 and the partition 101, the greater the downward slant of the first and second inflow pipes 111 and 121.

Referring to FIG. 4, the extension pipe 117 is disposed vertically along the inside wall of the body 100. The top of the extension pipe 117 is connected to the bottom end of both a first discharge pipe 215 and second discharge pipe 225 of the first and second cyclone units 210 and 220. The extension pipe 117 tapers downwards, and the bottom end fluidly communicates with a discharge hole 401 of the bottom cover 400. Additionally, a top surface 118 (see FIG. 2) of the extension pipe 117 slants downwards so that dust falls to the lower sides of the first and second chambers 110 and 120 rather than settling on the top surface 118. The greater the distance between the top surface 118 and the inside wall of the body 100, the greater the downward slant of the top surface 118.

Figure 9:
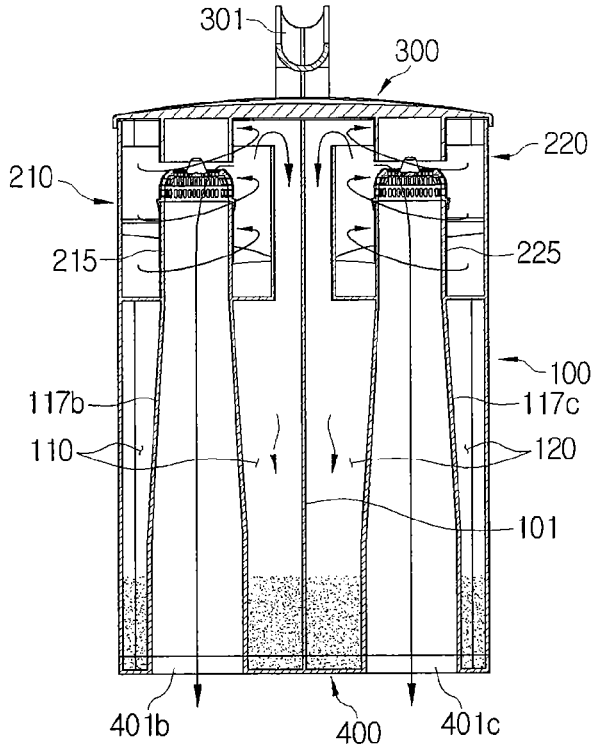
FIG. 9 is a sectional view of extension pipes connected to discharge pipes of first and second cyclone units, respectively, in a cyclone dust-collecting apparatus according to another exemplary embodiment of the present disclosure.

While a single extension pipe 117 is provided in this exemplary embodiment of the present disclosure, there is no limitation thereto. Accordingly, the present disclosure is also applicable to a situation shown in FIG. 9 in which a pair of extension pipes 117*b* and 117*c* are provided, which are connected to the bottom end of both the first and second discharge pipes 215 and 225 of the first and second cyclone units 210 and 220. In this situation, opposite sides of the pair of extension pipes 117*b* and 117*c* fluidly communicate with a pair of discharge holes 401*b* and 401*c* in the bottom cover 400.

The first and second cyclone units 210 and 220 are symmetrically disposed about the partition 101 in the first and second chambers 110 and 120. The first and second cyclone units 210 and 220 have overlapping portions 211 and 221 (see FIG. 2), which overlap with the body 100 and protrude from the body 100. Accordingly, dust-collecting space in the first and second chambers 110 and 120 may become wider as the volume of the overlapping portions 211 and 221 increases, and thus the dust-collecting capacity increases. Additionally, the overlapping portions 211 and 221 of the first and second cyclone units 210 and 220 may be made of transparent materials so that the interior of the first and second cyclone units 210 and 220 may be visible therethrough.

The first and second cyclone units 210 and 220 are disposed substantially above the first and second chambers 110 and 120, respectively. Additionally, upper ends 213 and 223 of the first and second cyclone units 210 and 220 are positioned lower than an upper end 103 of the body 100, so if the top cover 300 covers an upper portion of the body 100, a dust discharge space S may be formed between the upper ends 213 and 223 of the first and second cyclone units 210 and 220 and an inner surface 301 of the top cover 300. The discharge space S functions as a passage through which dust is discharged from the first and second cyclone units 210 and 220 to the first and second chambers 110 and 120.

The first and second discharge pipes 215 and 225 disposed inside the first and second cyclone units 210 and 220 are located on the same axis as the first and second cyclone units 210 and 220, respectively. A first spiral guide plate 217 and second spiral guide plate 227 are disposed on the outer circumference of the first and second discharge pipes 215 and 225, respectively. Accordingly, the first and second cyclone units 210 and 220 may cause dust-laden air flowing into the first and second cyclone units 210 and 220 to whirl, and may guide the dust-laden air towards upper portions of the first and second cyclone units 210 and 220. The first and second discharge pipes 215 and 225 includes a first grill filter 219 and second grill filter 229, respectively, on the upper portions thereof, so air that flows into the first and second discharge pipes 215 and 225 after dust has been separated by the centrifugal force, may be filtered through the first and second grill filters 219 and 229.

As shown in FIG. 1, the top cover 300 includes a pair of first mounting projections 304 and 305 that are spaced apart at a predetermined distance on one edge on the upper front portion of the body 100. The pair of first mounting projections 304 and 305 are hinged to a pair of first hinges 104 and 105 formed on the upper front portion of the body 100, respectively, so that the top cover 300 may open and close the upper portion of the body 100.

Figure 7:
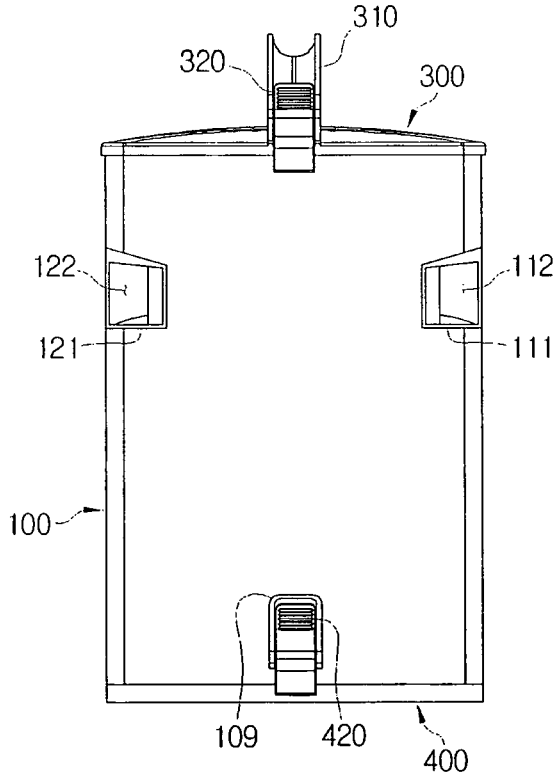
FIG. 7 is a rear view of a cyclone dust-collecting apparatus according to an exemplary embodiment of the present disclosure.

Additionally, as shown in FIG. 7, a handle 310 is disposed above the top cover 300 along the front and rear of the body 100. The handle 310 may be elastically hinged to a first unlock button 320, which is in contact with one side of the rear of the body 100. A hook 321 in the bottom end of the first unlock button 320 is detachably coupled to a first locking projection 131 protruding from the upper rear portion of the body 100, as shown in FIG. 8.

Furthermore, as shown in FIG. 4, the top cover 300 further includes a first stabilizing tube 331 and second stabilizing tube 332, which extend from an inner surface 301 of the top cover 300 and face the first and second discharge pipes 215 and 225, respectively, to cause dust-laden air to stably whirl inside the first and second cyclone units 210 and 220. Bottom ends of the first and second stabilizing tubes 331 and 332 protrude towards top ends of the first and second grill filters 219 and 229, but are not in contact with the top ends of the first and second grill filters 219 and 229.

Referring to FIG. 1, the bottom cover 400 includes a pair of second mounting projections 406 and 407, which are spaced apart at a predetermined distance on one edge on the lower front portion of the body 100. The pair of second mounting projections 406 and 407 are hinged to a pair of second hinges 106 and 107 formed on the lower front portion of the body 100, respectively. Accordingly, the bottom cover 400 may open the lower portion of the body 100, so that dust collected in the first and second chambers 110 and 120 may be discharged.

Figure 8:
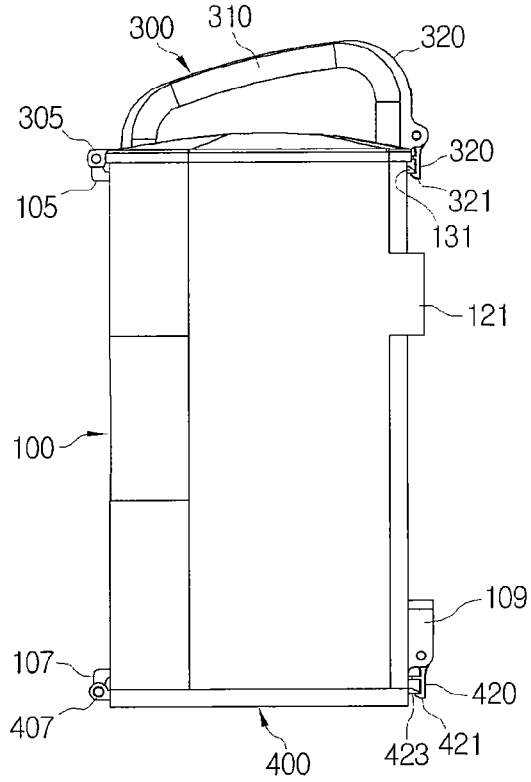
FIG. 8 is a side view of a cyclone dust-collecting apparatus according to an exemplary embodiment of the present disclosure.

Additionally, referring to FIG. 8, a bracket 109 is disposed on the lower rear portion of the body 100, and a second unlock button 420 is elastically hinged to the bracket 109 to lock or unlock the bottom cover 400. In order to lock or unlock the bottom cover 400, a second locking projection 423 protruding from the lower rear portion of the body 100 is detachably coupled to a hook 421 formed on a bottom end of the second unlock button 420, as shown in FIG. 8.

Hereinafter, the operation of the cyclone dust-collecting apparatus 10 according to the exemplary embodiment of the present disclosure constructed as described above will now be described in detail with reference to FIGS. 2 and 4.

If a suction motor (not illustrated) is driven when the cyclone dust-collecting apparatus 10 is mounted in the main cleaner body (not illustrated), dust-laden air on a surface being cleaned may be drawn into the first and second inflow pipes 111 and 121 through a suction port body (not illustrated). The dust-laden air then flows into the first and second cyclone units 210 and 220 and is made to whirl inside the first and second cyclone units 210 and 220 by the first and second spiral guide plates 217 and 227 towards the upper portions of the first and second cyclone units 210 and 220.

Accordingly, dust is separated from air by the centrifugal force and the separated dust is discharged to the first and second chambers 110 and 120 through the discharge space S. The discharged dust drops due to its own weight and is collected in the lower portions of the first and second chambers 110 and 120. More specifically, dust that has settled on the inclined top surfaces 114 and 124 of the first and second inflow pipes 111 and 121 falls along the top surfaces 114 and 124, and is collected in the lower portions of the first and second chambers 110 and 120. Similarly, dust that has settled on the top surface 118 of the extension pipe 117 also falls and is collected in the lower portions of the first and second chambers 110 and 120.

Therefore, the dust discharged from the first and second chambers 110 and 120 is all collected in the lower portions of the first and second chambers 110 and 120, rather than settling on the top surfaces of various components disposed inside the first and second chambers 110 and 120, so it is possible to discharge all dust without any dust remaining inside the first and second chambers 110 and 120.

Additionally, air from which dust has been separated by the first and second cyclone units 210 and 220 flows into the first and second discharge pipes 215 and 225 through the first and second grill filters 219 and 229, passes through the extension pipe 117 and via the discharge hole 401 of the bottom cover 400, and is discharged outwards from the cyclone dust-collecting apparatus 10.

If a user wishes to discharge or remove dust that has collected in the first and second chambers 110 and 120, he or she may separate the cyclone dust-collecting apparatus 10 from the main cleaner body (not illustrated), and may open the bottom cover 400 by pressing the second unlock button 420. This simple operation of pressing the second unlock button 420 makes it easier to empty the first and second chambers 110 and 120.

Furthermore, if maintenance of the first and second cyclone units 210 and 220 is required, for example if dust blocking the first and second cyclone units 210 and 220 needs to be removed, the user may easily open the upper portion of the body 100 by only a simple operation of pressing the first unlock button 320.

Although representative exemplary embodiment of the present disclosure has been illustrated and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust-collecting apparatus comprising:

a body having an opened lower portion;

at least one cyclone unit disposed to one side in the body to separate dust from air flowing into the body and discharge air from which the dust has been separated; and a bottom cover to open or close the lower portion of the body, wherein the body has an inflow pipe penetrating the body from a rear portion of the body and connected to the at least one cyclone unit, and the inflow pipe is formed integrally with and along an inside wall of the body and has an inclined top surface.

2. The cyclone dust-collecting apparatus of claim 1, wherein the inclined top surface of the inflow pipe is inclined downwards so that a distance between the inclined top surface of the inflow pipe and the inside wall of the body becomes longer.

3. The cyclone dust-collecting apparatus of claim 1, wherein the at least one cyclone unit comprises a discharge pipe to discharge air from which dust has been separated, and a bottom end of the discharge pipe is connected to an extension pipe fluidly communicating with a portion of the bottom cover.

4. The cyclone dust-collecting apparatus of claim 1, wherein the at least one cyclone unit protrudes outwards from the body and has a portion overlapping with the body.

5. The cyclone dust-collecting apparatus of claim 1, wherein the body has an opened upper portion, the cyclone dust-collecting apparatus further comprising a top cover to open and close the open upper portion of the body.

6. The cyclone dust-collecting apparatus of claim 5, further comprising a handle disposed above the top cover and a stabilizing tube extending from an inner surface of the top cover and facing the discharge pipe of the at least one cyclone unit.

7. A cyclone dust-collecting apparatus comprising:

a body comprising a first chamber and a second chamber that are divided by a partition;

a first cyclone unit and a second cyclone unit that are disposed to one side in the first and second chambers, respectively, to separate dust from air flowing into the body and discharge air from which the dust has been separated; and a bottom cover to open and close a lower portion of the body, wherein the body comprises a first inflow pipe and a second inflow pipe penetrating the body from a rear portion of the body and connected to the first and second cyclone units, respectively, and the first and second inflow pipes are formed integrally with and along an inside wall of the body and have inclined top surfaces.

8. The cyclone dust-collecting apparatus of claim 7, wherein the first and second inflow pipes are connected at a tangent to respective sides of the first and second cyclone units, respectively.

9. The cyclone dust-collecting apparatus of claim 7, wherein the inclined top surfaces of the first and second inflow pipes are inclined downwards so that the distance between the inclined top surfaces of the first and second inflow pipes and the inside wall of the body becomes longer.

10. The cyclone dust-collecting apparatus of claim 7, wherein the first and second inflow pipes are disposed along the partition of the body, and the inclined top surfaces of the first and second inflow pipes are inclined downwards so that the distance between the inclined top surfaces of the first and second inflow pipes and the partition of the body becomes longer.

11. The cyclone dust-collecting apparatus of claim 7, wherein the first and second cyclone units comprise a first discharge pipe and a second discharge pipe to discharge air from which dust has been separated, respectively, and bottom ends of the first and second discharge pipes are connected to a single extension pipe fluidly communicating with a portion of the bottom cover.

12. The cyclone dust-collecting apparatus of claim 11, wherein the extension pipe is disposed along the inside wall of the body, and a top surface of the extension pipe is inclined downwards so that the distance between the top surface of the extension pipe and the inside wall of the body becomes longer.

13. The cyclone dust-collecting apparatus of claim 7, wherein the first and second cyclone units comprise a first discharge pipe and a second discharge pipe to discharge air from which dust has been separated, respectively, and bottom ends of the first and second discharge pipes are connected to a pair of extension pipes fluidly communicating with a portion of the bottom cover, respectively.

14. The cyclone dust-collecting apparatus of claim 7, wherein the first and second cyclone units protrude outwards from the body and have portions overlapping with the body, respectively.

15. The cyclone dust-collecting apparatus of claim 7, further comprising a top cover to open and close an upper portion of the body.

16. The cyclone dust-collecting apparatus of claim 15, further comprising a handle disposed above the top cover and a first stabilizing tube and a second stabilizing tube extending from an inner surface of the top cover and facing the first and second discharge pipes, respectively.

* * * * *